US007116305B2

(12) United States Patent
Naiki

(10) Patent No.: US 7,116,305 B2
(45) Date of Patent: Oct. 3, 2006

(54) DISPLAY DRIVING DEVICE, DISPLAY APPARATUS, AND METHOD OF DRIVING THE SAME

(75) Inventor: Takashi Naiki, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 440 days.

(21) Appl. No.: 10/160,953

(22) Filed: May 30, 2002

(65) Prior Publication Data

US 2002/0190941 A1 Dec. 19, 2002

(30) Foreign Application Priority Data

Jun. 13, 2001 (JP) ..... 2001-178429

(51) Int. Cl.
*G09G 3/36* (2006.01)

(52) U.S. Cl. ..... 345/98; 345/204; 345/211

(58) Field of Classification Search ..... 345/99–101, 345/211, 204, 205, 98
See application file for complete search history.

(56) References Cited

U.S. PATENT DOCUMENTS 5,018,109 A * 5/1991 Shinoda et al. ..... 365/230.08
5,610,622 A * 3/1997 Takeda et al. ..... 345/13
5,657,044 A * 8/1997 Makino ..... 345/103
5,778,237 A * 7/1998 Yamamoto et al. ..... 713/322
6,522,319 B1 * 2/2003 Yamazaki ..... 345/103

* cited by examiner

*Primary Examiner*—Richard Hjerpe
*Assistant Examiner*—Jean Lesperance
(74) *Attorney, Agent, or Firm*—Hogan & Hartson LLP

(57) ABSTRACT

A display driving device adapted to output a column driving voltage to a sequentially selected one of row terminals of a display panel during a respective row selection period. The row selection period includes an accessing period for accessing a display memory and an idling period in which no access is made. At least a portion of the idling period may be provided prior to the accessing period. The idling period may be regulated in accordance with the display mode chosen.

14 Claims, 4 Drawing Sheets

DISPLAY DRIVING DEVICE, DISPLAY APPARATUS, AND METHOD OF DRIVING THE SAME

FIELD OF THE INVENTION

The invention relates to a display such as a liquid crystal display (LCD) and an electro-luminescence (EL) display operable at a reduced power in accordance with the display mode chosen. The invention also relates to a method of driving a display and a display driving device for use in such display.

BACKGROUND OF THE INVENTION

Display means including LCD are widely used in many portable electronic apparatuses such as, mobile phones personal handyphone systems (PHSs), and personal digital assistants (PDAs).

LCD used in these electronic apparatuses are increasingly equipped with a larger display panel having an increased number of tone levels in order to improve the visibility of information on the LCD. This inevitably entails greater power consumption by a display. Power saving is important for a portable electronic apparatus since it directly affects the operable hours of the apparatus if it is powered by a battery.

In order to save energy, information is displayed on a limited area of a large LCD panel (the limited area hereinafter referred to as display area), or at a limited tone level, when the entire area is not needed or the panel is not in operation or in communication with other components of the apparatus. Thus, the amount of data to be displayed by the panel is reduced in a reduced display mode to reduce the driving frequency of the panel, i.e. to prolong the period for selecting each row of the panel (the period hereinafter referred to as row selection period). A maximum possible power saving can be attained if the driving frequency is precisely lowered to an optimum power saving frequency.

FIG. 1 is a block diagram showing a conventional LCD driving device designed to operate at a lowered frequency to save power depending on the display mode selected. FIG. 2 is a timing diagram for the operation of the LCD driving device of FIG. 1.

The LCD driving device for an LCD panel 20 shown in FIG. 1 has an interface 11, a display memory 12, a display controller 33, an LCD driver 14, and a clock generator 35.

The interface 11 receives externally supplied display data, which is stored in the display memory 12.

The clock generator 35 generates a system clock SCK suitable for a specified display mode. The clock is supplied to other components including the display controller 33.

In addition to system clock SCK, the display controller 33 is supplied with information specifying a display mode which defines the display area and the tone level for the data. The display data stored in the display memory 12 is retrieved therefrom and supplied to the LCD driver 14 in accordance with the display mode. Timing of the retrieval is performed based on the system clock SCK. Under the control of the display controller 33, the LCD driver 14 determines a driving voltage for driving the LCD panel 20 based on the display data received from the display controller 33. Incidentally, the LCD driving device is formed in one chip or several chips, and is controlled by a CPU for example.

Referring to FIGS. 2A and 2B, there are shown operations of this conventional LCD driving device controlling the LCD panel 20. FIGS. 2A and 2B illustrate relationships between timings of: (a) row selection, (b) supply voltage, (c) column output, (d) system clock SCK, and (e) access to the display memory.

Row terminals (e.g. common terminal) of the LCD panel 20 are selected in sequence from the upper most one to the lowest one at a given timing (the timing will be hereinafter referred to as row selection timing). The time interval Tr1 between the two successive row selections, referred to as row selection period, as shown in FIG. 2A(a) is determined appropriately according to the number of row terminals and/or tone levels to be selected in one frame. A shorter row selection period Tr1 is required for a larger display area and/or a high tone level.

On the other hand, respective column terminals (e.g. segment terminals) of the LCD panel 20 are provided with driving voltages associated with a line of selected row terminals. The display controller 33 prepares data for the next row selection period (the data will be referred to as the next display data). This can be done by accessing the display memory 12 a number of times while the LCD driver 14 is providing the current row selection column output. For example, while driving voltages are applied to the column terminals associated with a row line i−1 as shown in FIG. 2A(c), the next display data for the next line i is sequentially retrieved from the display memory 12 by accessing the memory a number of times (indicated by upward arrows) as shown in FIG. 2A(e).

In the example shown herein the frequency of such memory access in one selection period Tr1 is 8 as shown in FIG. 2A(e). However, the frequency is actually determined by the ratio of the amount of data for one line and the amount of data that can be retrieved from the display memory 12 in one read.

In the conventional LCD driving device shown in FIG. 1, an instruction specifying the display mode is provided not only to the display controller 33 but also to the clock generator 35 so that the clock generator 35 will reduce the frequency of the clock SCK, as shown in FIG. 2B (d), when the amount of display data decreases in a reduced display mode requiring only a reduced display area and/or a lower tone level. Accordingly, in order to minimize power consumption by the LCD by reducing the frequency of selection timing (and hence the driving frequency of the LCD), a longer row selection period Tr2 is selected as shown in FIG. 2B(a).

This conventional LCD driving device requires a clock generator capable of generating a variable system clock SCK for clocking the LCD panel in reduced display modes (associated with low tone levels and partial display areas). In order to provide the clock generator with this capability, the time constant of the clock generator 35 is regulated to provide a required frequency. It is then necessary to provide means for precisely regulating the time constant (referred to as time constant regulator) of the clock generator 35 over a wide range of frequency, which is not easy.

If, however, the clock generator 35 is provided with an external time constant regulator, it is not possible to program the regulator by an internal controller such as CPU to automatically generate a desired time constant depending on different display modes. A frequency divider may be provided in a stage following the clock generator 35 for regulating the driving frequency of the LCD. However, since such a frequency divider has a frequency division ratio m, where m is an integer, it can only change the clock frequency by a factor of 1/m, failing to provide fine regulation of the driving frequency.

It should be noted that in an LCD driving device the supply voltage Vdd of a battery is temporarily lowered by the driving current activating one row of the LCD panel immediately after the activation (i.e. selection) of the row, as shown in FIG. 2A(b) and FIG. 2B (b). Since each of the LCD pixels in the row has a capacitance, they dissipate energy every time the voltage impressed upon them changes (due to the fact that then charging and discharging currents flow through them). The charging currents inevitably results in a further disadvantage that it causes a voltage drop due to the impedance of the LCD panel.

In portable apparatuses utilizing an LCD panel, the supply voltage is provided by a common battery, that the voltage drop pertinent to the LCD driving device, results in the voltage drops in other components such as display memory. In the conventional LCD driving device, the voltage drop can cause an erroneous display data read from the display memory 12, since display data is retrieved from the display memory 12 in the row selection period Tr1 and Tr2 but it is difficult to maintain a minimum necessary operational voltage for the read if such voltage drop takes place.

SUMMARY OF THE INVENTION

It is therefore an object of the invention to provide a method of easily and precisely regulating the frequency of a display driving device according to the display mode selected, even when it is a low tone mode and a partial display mode.

It is another object of the invention to provide a display driving device utilizing the method.

It is a further object of the invention to provide a display apparatus having the display driving device.

It is a still further object of the invention to provide a method of driving a display driving device which is little affected by a voltage drop in the supply voltage immediately after row selection during a read of data from the display memory.

It is a further object of the invention to provide a display driving device utilizing this method.

It is a still further object of the invention to provide a display apparatus having the display driving device.

In accordance with one aspect of the invention, there is provided a method of driving a display panel having multiple row lines and multiple column lines. The method comprises steps of:

driving the multiple column lines while a driver is driving one of the multiple row lines in a row selection period, based on display data read from a display memory, wherein the row selection period includes: an accessing period for accessing the display memory to read the display data for the column lines and sending the column line data to the driver; and an idling period for making no access; and reading the column line data for the next row line to be displayed during the next row selection period from the display memory in time intervals within said accessing period.

The row selection period of the invention consists of an accessing period for accessing the display memory and an idling period in which access is not made. Consequently, in a low tone mode or in a partial display mode where the display driving device is run at a reduced frequency, the frequency may be easily and precisely changed by changing the idling period.

The idling period lasts an integral multiple of the system clock such that at least one part of the idling period is provided at the beginning of the row selection period and prior to the accessing period. If this idling period is set to cover a voltage drop that takes place immediately after row selection, the effect of the voltage drop can be minimized, thereby minimizing errors in the data read from the display memory. Since the timing of the column output is not synchronized with the memory access, power consumption takes place randomly over the driving period, resulting in only negligible fluctuations in the supply voltage.

In the invention, the number of clocks n defining the idling period, and hence the row selection period, may be arbitrarily changed by a control signal. By increasing n, the row selection period may be easily extended to reduce the frequency of accessing the display memory as well as the frequency of selecting a row line (row line selection frequency). This can be done in such a way that part of n clocks of the idling period precedes the row selection period, with the preceding clocks variable in accordance with the display mode (e.g. low tone mode and/or partial display mode) to reduce the power consumed in the memory access and in driving the display driving device. The invention thus allows easy and precise regulation of the driving frequency of the display driving device by merely changing the number n of the idling clocks without changing the frequency of the system clock.

The invention also permits alteration of the frequency of the system clock. This can be done by using a frequency divider. Thus, when coupled with the regulation of idling clocks as mentioned above, it is possible by the invention to attain a wide range of delicate control of the display frequency (or equivalently of row selection period).

DETAILED DESCRIPTION OF THE PREFERRED EMBODIMENT

The invention will now be described in detail by way of example with reference to the accompanying drawings. The invention, however, is not limited to the examples shown herein, but may be modified within the scope of the invention. For example the invention may be applied equally well to other types of display apparatus such as an organic electro-luminescence apparatus.

Figure 3:
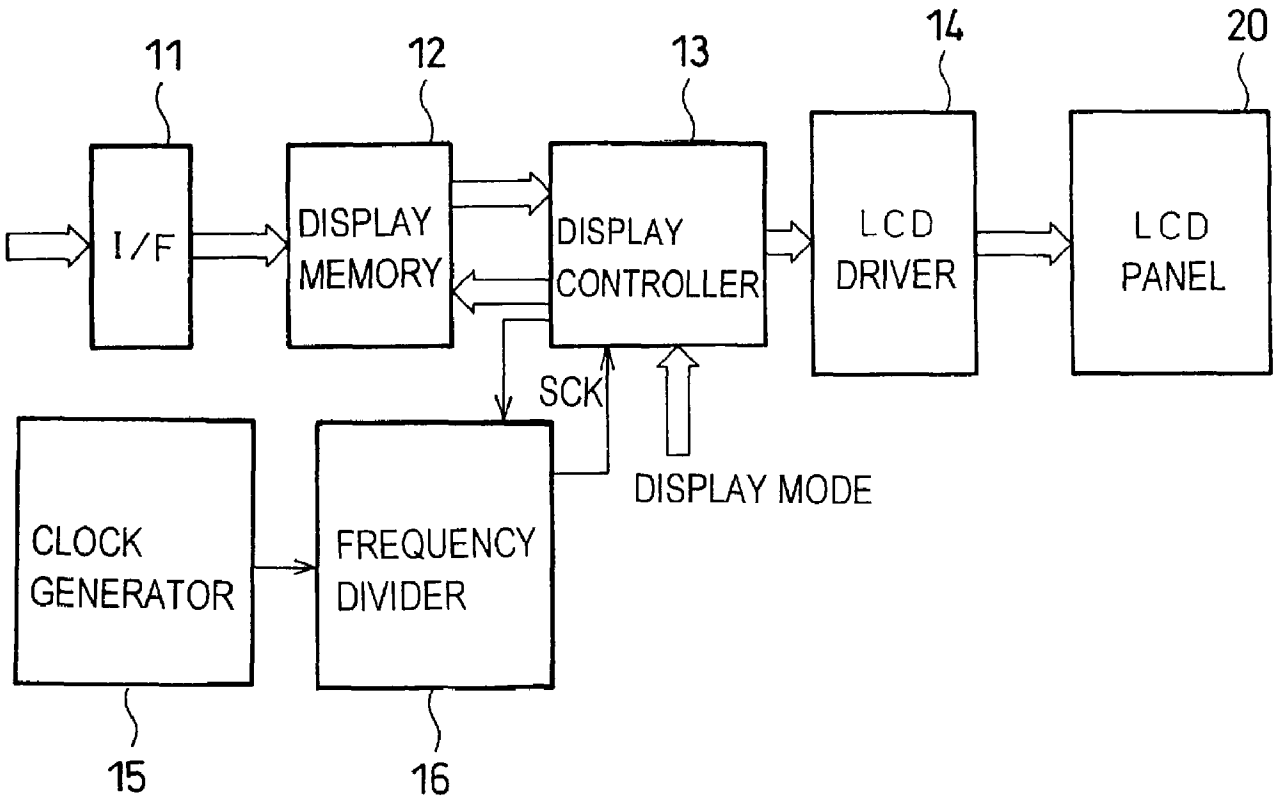
FIG. 3 is a block diagram of a preferred embodiment of LCD driving device according to the invention.
Figures 4A, 4B:
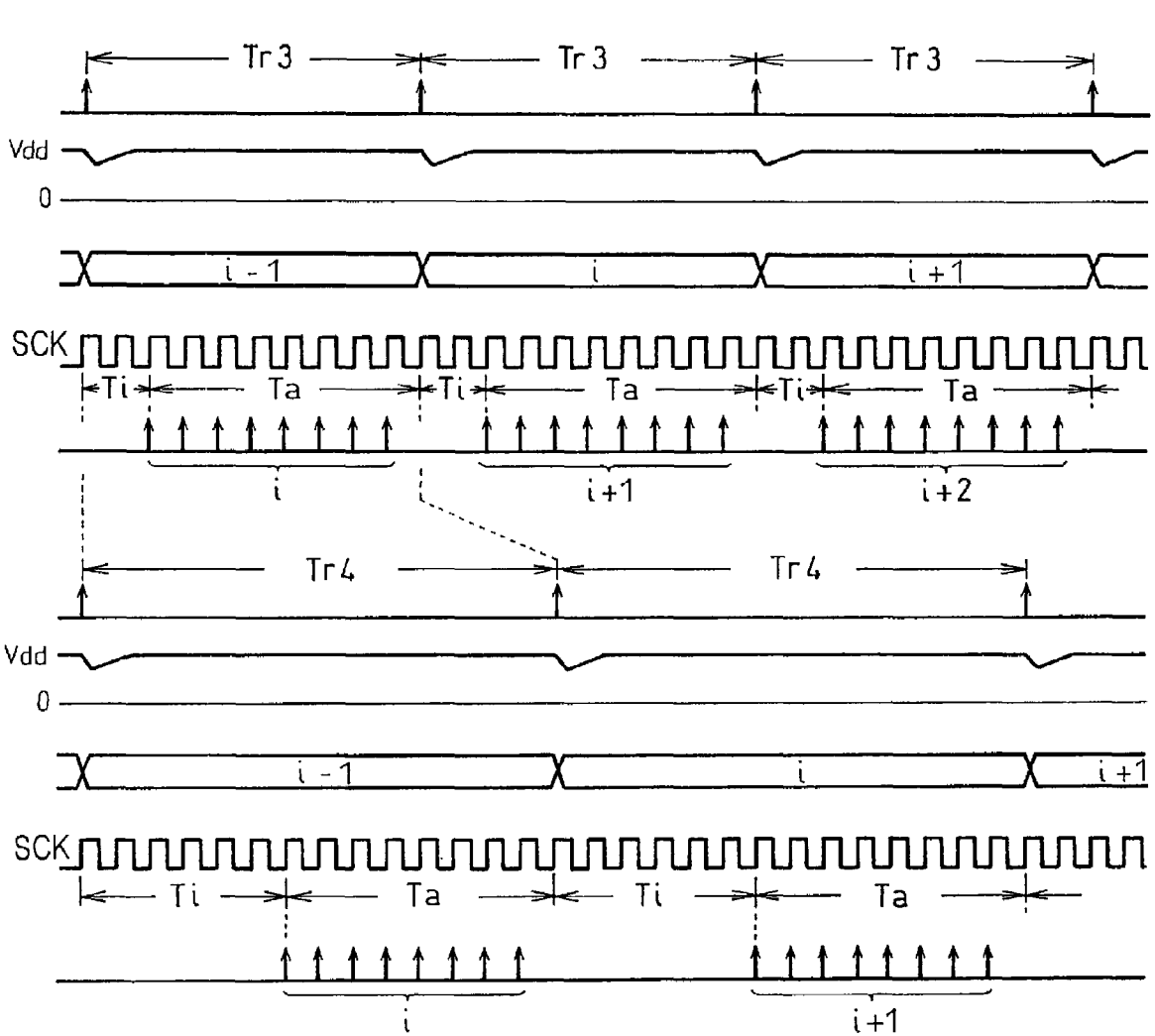
FIGS. 4A and 4B are timing diagrams illustrating operation of the LCD driving device shown in FIG. 3.

Referring now to FIG. 3, there is shown an LCD driving device implementing the invention. FIGS. 4A and 4B are timing diagrams illustrating operation of the LCD driving device of FIG. 3.

Figure 1:
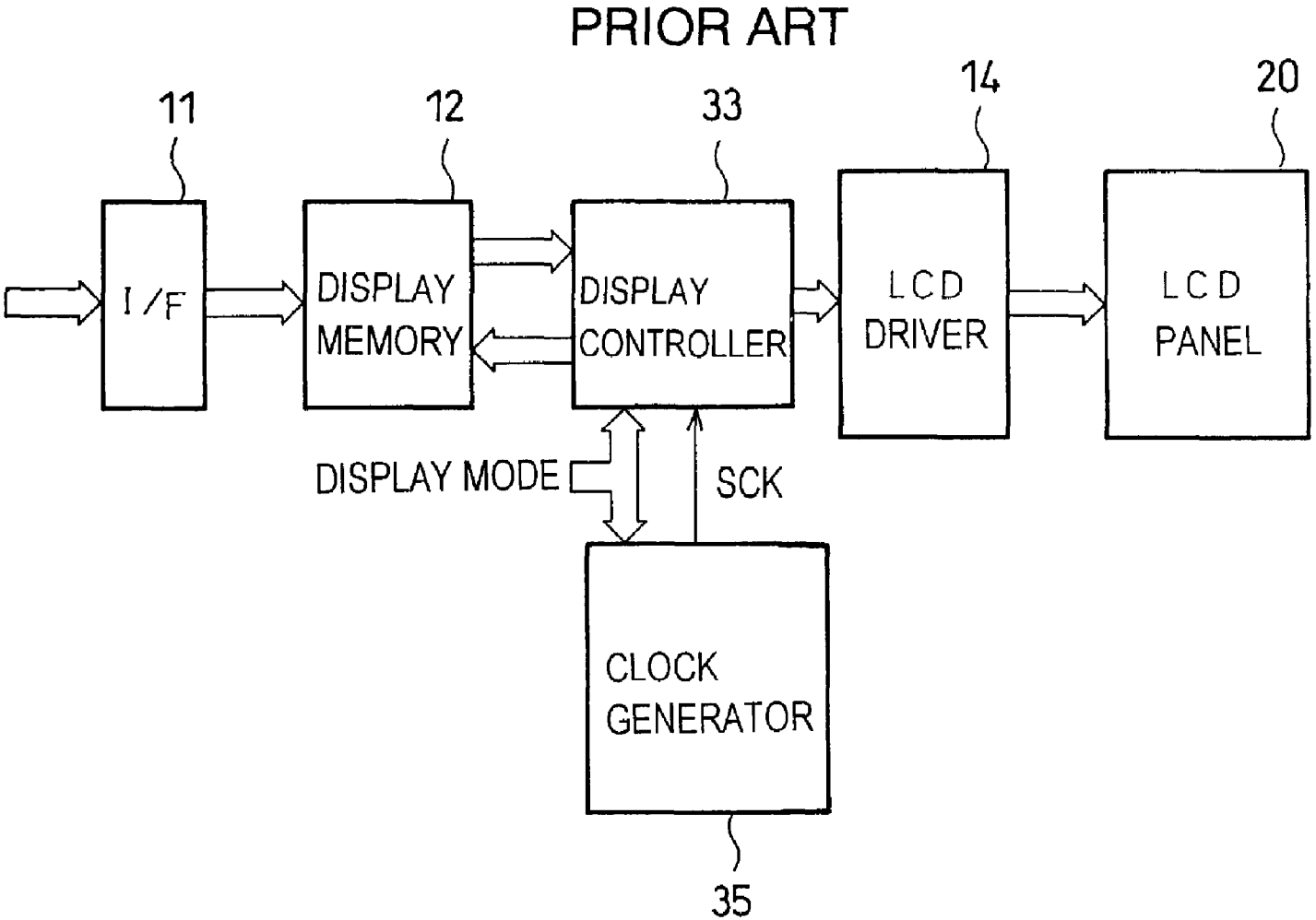
FIG. 1 PRIOR ART
FIG. 1 is a block diagram of a conventional LCD driving device.
Figures 2A, 2B:
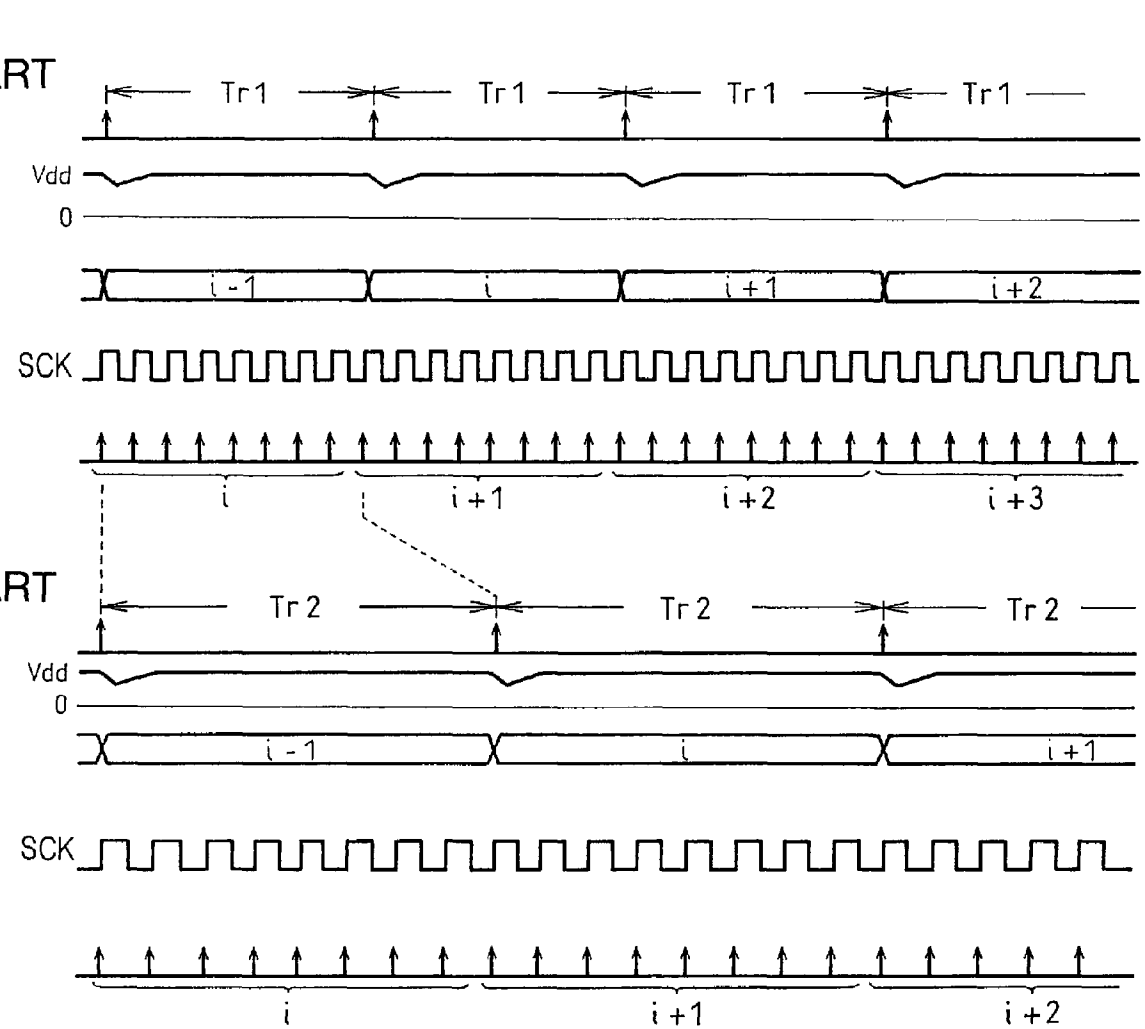
FIG. 2A PRIOR ART
FIG. 2B PRIOR ART
FIGS. 2A and 2B are timing diagrams illustrating operation of the LCD driving device shown in FIG. 1.

The LCD driving device includes an interface 11, a display memory 12, an LCD driver 14, and an LCD panel 20, as shown in FIG. 3, which can be the same as corresponding elements shown in FIG. 1.

A depression of voltage (hereinafter referred to as voltage depression) takes place immediately after each row selection, which can influence on display data read from the display memory 12. In order to minimize this influence in accordance with the invention, a row selection period Tr3 (normal mode) and Tr4 (in a reduced mode) consist of an idling period Ti and an accessing period Ta. The accessing period Ta is provided for the controller to access the display memory 12 a number of times to read data therefrom. The idling period Ti consists of a predetermined number (n) of system clocks SCK.

Depending on which of the display modes (e.g. low tone mode and partial display mode) is selected, the number (n) of the clocks defining the idling period may be changed, without changing the frequency of the system clock, to reduce the power consumed in accessing the display memory and in driving the LCD.

Because of this feature, the display controller 13 of the invention has a different way of controlling the LCD as compared with the conventional display controller of FIG. 1. In this context, the clock generator 15 of the invention is also different in configuration from a conventional one. The display controller 13 is adapted to control a frequency divider 16 such that the frequency divider 16 divides the frequency of the system clock SCK generated by the clock generator 15 as needed.

Operation of the LCD apparatus will now be described with additional reference to FIGS. 4A and 4B. Basic operation to control the LCD driving device of the invention is the same as that of a conventional driving device, where row terminals (common terminals for example) of the LCD panel 20 are sequentially selected from the upper most one to the lowest one at a predetermined row selection timing. The row selection period Tr3 shown in FIG. 4A(a), which is the period of row selection, is determined appropriately based on the number of row terminals to be selected for one scanning period and on the tone level selected. Therefore, in general the larger the display area and/or the higher the display tone, the shorter is the row selection period Tr3.

Each of the column terminals (e.g. segment terminals) of the LCD panel 20 is provided with a driving voltage, i.e. a column output (FIGS. 4A(c) and 4B(c)), for driving pixels in the selected row and associated with the column terminals. In preparation, data to be displayed in the next row selection period is retrieved from the display memory 12 in a number of accessing times while the LCD driver 14 is providing column outputs to the columns in the current row selection period.

FIG. 4A is a timing diagram for driving the LCD panel in a mode where the display area is relatively large and the tone level is high. The row selection timing (a) has a rather short row selection period Tr3. The supply voltage normally maintains a nominal voltage Vdd, but is depressed immediately after each row selection timing, as shown in FIG. 4A (b). Note, however, that the present system will not be appreciably influenced by the voltage depression as will be seen below. FIG.

4A (c) shows the driving voltages supplied by the LCD driver 14 to the column terminals of the LCD panel 20 associated with the selected row terminals.

The system clock SCK shown in FIG. 4A (d) generated by the clock generator 15 has a constant frequency. The clock SCK is a time basis for various operations of the LCD including the row selection timing.

Under the timing of accessing the display memory 12 shown in FIG. 4A (e), the display controller 13 retrieves display data to be displayed in the next row selection period Tr3 by accessing the display memory 12 a multiplicity of times while the LCD driver 14 is providing column outputs (e.g. i−1) in the current row selection period Tr3.

In this memory access scheme, the row selection period Tr3 consists of an accessing period Ta for accessing the display memory 12 a number of times retrieving necessary display data from the display memory 12 and an idling period Ti in which no access is made to the display memory 12. The idling period Ti can be arbitrarily short so long as it covers the period of voltage depression of the supply voltage immediately after each row selection, so that the idling period Ti does not appreciably affect display operation.

Since the LCD driving device, and more particularly the display controller 13, is configured as described above, lines of row terminals of the LCD panel 20 are sequentially selected at the row selection timing, and the column outputs are supplied to the column terminals associated with the selected row.

It would be appreciated that the idling period provided immediately after the row section ensures elimination of erroneous data, caused by the depression of the supply voltage accompanying the row selection.

Although memory access also consumes additional power, it will not cause an appreciable voltage depression that can cause erroneous data reading, since the access (FIG. 4A (e)) is not synchronized with the column output (FIG. 4A (c)) to help evenly distribute power consumption.

Referring now to FIG. 4B, operation of the LCD panel 20 in a reduced display mode will be described in which the display area and/or the tone level of the LCD panel 20 are/is reduced in response to a reduced mode instruction.

Upon receiving this mode instruction, frequency of the row selection timing shown in FIG. 4B (a) is reduced to lower the power consumption.

The reduction of frequency of the row selection timing results in a longer row selection period Tr4. It is recalled that in conventional methods system clock itself is varied by varying the time constant of a clock generator 35.

In contrast, the frequency of the system clock SCK generated by the clock generator 15 of the invention may be maintained constant, providing a precise clock in a stable condition. Instead, the row selection period Tr4 is varied by varying the idling period Ti, which includes an appropriate number of system clocks, such that the idling period Ti plus the accessing period Ta will give precisely a preferred row selection period Tr4.

If a still longer row selection period Tr4 is preferred, the system clock SCK may be frequency-divided by a frequency divider 16 by a frequency division ratio as specified by an instruction received from the display controller 13. With this frequency-divided clock, preferred row selection period Tr4 may be set up precisely over a wide range by appropriately varying the idling period Ti and accessing period Ta.

It is noted that the idling period Ti alone can be arbitrarily set longer or shorter as needed. For example, when a very short row selection period is required in such a display mode as animation mode, the idling period Ti may be shortened, possibly down to zero in an extreme case.

It is noted that the idling period Ti need not be entirely provided at the beginning of each row selection period. It suffices to provide the idling period partly at the beginning of the row selection period so that it covers the voltage depression that appears immediately after the row selection. The rest of the idling period may be provided intermediate or after the accessing period Ta.

What I claim is:

1. A method of driving a display panel having multiple row lines and multiple column lines, said method comprising steps of:

driving said multiple column lines while a driver is driving one of said multiple row lines in a row selection period, based on display data read from a display memory, wherein said row selection period includes: an accessing period for accessing said display memory to read display data for said column lines (said display data referred to as column line data) and outputting said column line data to said driver; and an idling period for making no access to said display memory, such that each of row selection periods for selecting said multiple row lines includes said idling period at the beginning of said row selection period and said accessing period at the end of said idling period; and reading the column line data for the next row line to be displayed during the next row selection period from the display memory in time intervals within said accessing period, each of said intervals shorter than said accessing period.

2. The method according to claim 1, wherein said idling period is defied by a predetermined number (n) of clocks which are provided partly immediately after each row selection.

3. The method according to claim 2, wherein said number (n) of clocks defining said idling period is regulated by a control signal to be an arbitrary number thereby making said row selection period variable.

4. The method according to claim 3, wherein the frequency of said clock is variable.

5. A display driving device, comprising:

a display memory for storing display data;

a driver for driving multiple column lines of a display panel based on display data retrieved from said display memory, during a period in which one of multiple row lines of said display panel is selected (said period referred to as row selection period); and a display controller for retrieving display data from said display memory in time intervals within said row selection period, and outputting said display data to said driver, and wherein said row selection period includes: an accessing period for accessing said display memory to retrieve display data for said column lines (said display data referred to as column line data) and outputting said column line data to said driver, and an idling period in which no access is made, wherein each of row selection periods for selecting said multiple row lines and includes said idling period at the beginning of said row selection period and said accessing period at the end of said idling period; and wherein the display controller reads the column line data for the next row line to be displayed during the next row selection period from the display memory in time intervals within said accessing period, each of said intervals shorter than said accessing period.

6. The display driving device according to claim 5, wherein said display controller is adapted to access said display memory a number of times during said accessing period of current row selection period to retrieve display data stored therein, and to output said display data to said driver prior to the next row selection period.

7. The display driving device according to claim 6, wherein said idling period is defined by a predetermined number (n) of clocks which are provided partly immediately after each row selection.

8. The display driving device according to claim 7, wherein said number (n) of clocks defining said idling period is regulated by a control signal to be an arbitrary number thereby making said row selection period variable.

9. The display driving device according to claim 8, wherein the frequency of said clock is variable.

10. A display apparatus, comprising:

a display panel having multiple row lines and multiple column lines;

a display memory for storing display data;

a driver for driving multiple column lines based on display data retrieved from said display memory, during a period in which one of said multiple row lines is selected (said period referred to as row selection period);

a display controller for retrieving display data from said display memory in time intervals within said row selection period and outputting said display data to said driver, and wherein said row selection period includes:

an accessing period for accessing said display memory to read display data for said column lines (said display data referred to as column line data) and outputting said column line data to said driver, and an idling period in which no access is made, wherein each of row selection periods for selecting said multiple row lines includes said idling period at the beginning of said row selection period and said accessing period at the end of said idling period, and wherein the display controller reads the column line data for the next row line to be displayed during the next row selection period from the display memory in time intervals within said accessing period, each of said intervals shorter than said accessing period.

11. The display apparatus according to claim 10, wherein said display controller is adapted to access said display memory a number of times during said accessing period of current row selection period to retrieve display data stored therein, and to output said display data to said driver prior to the next row selection period.

12. The display apparatus according to claim 11, wherein said idling period is defined by a predetermined number (n) of clocks which are provided partly immediately after each row selection.

13. The display apparatus according to claim 12, wherein said number (n) of clocks defining said idling period is regulated by a control signal to be an arbitrary number thereby making said row selection period variable.

14. The display apparatus according to claim 13, wherein the frequency of said clock is variable.

* * * * *